US010903594B2

(12) United States Patent
Herring et al.

(10) Patent No.: US 10,903,594 B2
(45) Date of Patent: Jan. 26, 2021

(54) BOARD-TO-BOARD CONNECTOR ASSEMBLY FOR ADD-IN CARDS

(71) Applicant: TE CONNECTIVITY CORPORATION, Berwyn, PA (US)

(72) Inventors: Michael David Herring, Apex, NC (US); Matthew Ryan Schmitt, Middletown, PA (US); Arash Behziz, Newbury Park, CA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/516,413

(22) Filed: Jul. 19, 2019

(65) Prior Publication Data

US 2020/0106201 A1 Apr. 2, 2020

Related U.S. Application Data

(60) Provisional application No. 62/739,554, filed on Oct. 1, 2018.

(51) Int. Cl.

| | |
|---|---|
| ***H01R 12/72*** | (2011.01) |
| ***H01R 12/73*** | (2011.01) |
| ***H01R 13/627*** | (2006.01) |
| ***H01R 12/79*** | (2011.01) |
| ***H01R 12/78*** | (2011.01) |

(52) U.S. Cl.

CPC ..... *H01R 12/725* (2013.01); *H01R 12/732* (2013.01); *H01R 12/78* (2013.01); *H01R 12/79* (2013.01); *H01R 13/6272* (2013.01)

(58) Field of Classification Search

CPC .... H01R 12/725; H01R 12/732; H01R 12/78; H01R 12/79; H01R 13/6272

USPC ..... 710/306, 305, 311, 300, 310; 439/258, 439/260, 74, 59, 65, 502, 507, 511–514, 439/952

See application file for complete search history.

(56) References Cited

U.S. PATENT DOCUMENTS 5,195,897 A * 3/1993 Kent ..... H01R 12/79 439/267
5,228,039 A * 7/1993 Knoke ..... G06F 11/3652 714/28
5,542,854 A * 8/1996 Bowen ..... H01R 12/7005 439/157
5,598,627 A * 2/1997 Saka ..... H01R 12/62 174/72 A
5,642,337 A * 6/1997 Oskay ..... G06F 3/0601 348/E7.073
5,650,910 A * 7/1997 Winick ..... G06F 1/183 361/679.6
5,692,910 A * 12/1997 Mittal ..... H05K 1/117 439/59

(Continued)

*Primary Examiner* — Harshad C Patel

(57) ABSTRACT

A board-to-board connector assembly includes a connector interposer between first and second connectors each having a connector housing holding contacts and having a card slot for interfacing with a circuit card edge of a corresponding add-in card. The connector housings have board guides configured to engage the add-in cards and guide mating therewith. The connectors have latches configured to latchably engage the add-in cards to secure the connector to the add-in cards. The connector interposer electrically interconnects the first contacts and the second contacts.

20 Claims, 8 Drawing Sheets

(56) References Cited

U.S. PATENT DOCUMENTS 5,740,378 A * 4/1998 Rehl ..... G06F 13/4081 710/302
5,751,977 A * 5/1998 Alexander ..... G06F 13/4226 710/310
5,848,252 A * 12/1998 Granau ..... G06F 13/4027 710/306
6,029,216 A * 2/2000 Hoglund ..... G06F 13/4086 326/30
6,061,806 A * 5/2000 Caldwell ..... G06F 11/2005 710/100
6,222,739 B1 * 4/2001 Bhakta ..... G06F 1/184 257/686
6,324,071 B2 * 11/2001 Weber ..... H05K 7/023 361/785
6,357,023 B1 * 3/2002 Co ..... G01R 31/01 714/42
6,535,367 B1 * 3/2003 Carpenter ..... H01R 31/08 361/42
6,572,403 B2 * 6/2003 Reimund ..... H01R 25/006 439/507
6,590,781 B2 * 7/2003 Kollipara ..... G06F 13/409 174/250
6,743,045 B1 * 6/2004 Hayashi ..... H01R 13/33 439/492
6,942,511 B1 * 9/2005 Orsley ..... H01R 12/79 439/218
6,966,784 B2 * 11/2005 Van Schuylenbergh ..... H01R 12/78 361/261
7,168,961 B2 * 1/2007 Hsieh ..... H01R 12/716 439/74
7,442,076 B2 * 10/2008 Huang ..... H01R 13/641 439/188
7,470,160 B1 12/2008 Mostoller et al.
7,500,041 B2 * 3/2009 Danilak ..... G06F 3/1438 710/305
7,517,228 B2 * 4/2009 Baskaran ..... H05K 1/147 439/67
8,432,705 B2 * 4/2013 Ge ..... G06F 1/185 361/728
8,575,529 B2 * 11/2013 Asahi ..... G02B 6/4201 250/205
8,589,608 B2 * 11/2013 Brodsky ..... G06F 13/409 361/748
8,949,509 B2 * 2/2015 Schuette ..... G06F 3/061 711/103
9,033,744 B2 5/2015 Chen
9,581,776 B1 * 2/2017 Lee ..... G02B 6/4292
9,713,280 B2 * 7/2017 Lai ..... H05K 7/1432
9,801,301 B1 * 10/2017 Costello ..... H05K 7/1447
10,485,106 B2 * 11/2019 Roh ..... H05K 1/14
2005/0110406 A1 * 5/2005 Jeong ..... H01R 12/62 313/582
2006/0067066 A1 * 3/2006 Meier ..... G06F 1/184 361/785
2009/0023330 A1 * 1/2009 Stoner ..... H01R 9/096 439/493
2011/0117768 A1 * 5/2011 Li ..... H01R 12/7029 439/345
2011/0304966 A1 * 12/2011 Schrempp ..... G06F 1/186 361/679.4
2012/0030455 A1 * 2/2012 McLaughlin ..... G06F 13/409 713/2
2012/0133385 A1 * 5/2012 Ataka ..... G01R 31/2877 324/756.05
2012/0221761 A1 * 8/2012 Brodsky ..... G06F 13/385 710/311
2014/0160686 A1 * 6/2014 Benson ..... H02M 7/003 361/724
2014/0217571 A1 * 8/2014 Ganesan ..... H01R 12/62 257/693
2015/0079845 A1 * 3/2015 Wanha ..... H01R 13/6477 439/607.41
2015/0162680 A1 * 6/2015 Costello ..... H01R 9/2408 439/64
2018/0359856 A1 * 12/2018 Roh ..... H05K 1/182

* cited by examiner

BOARD-TO-BOARD CONNECTOR ASSEMBLY FOR ADD-IN CARDS

CROSS REFERENCE TO RELATED APPLICATIONS

This application claims benefit to U.S. Provisional Application No. 62/739,554, filed Oct. 1, 2018, titled "BOARD-TO-BOARD CONNECTOR ASSEMBLY FOR ADD-IN CARDS", the subject matter of which is herein incorporated by reference in its entirety.

BACKGROUND OF THE INVENTION

The subject matter herein relates generally to board-to-board connector assemblies for add-in cards.

Electronic devices, such as computing devices, use communication systems to electrically connect and communicate data between various components of the system. For example, for high power computing devices, such as in hardware accelerators, general purpose GPUs, and the like, host circuit boards are provided with electrical connectors that allow add-in cards to be electrically connected into the system to enhance computing capabilities of the system. The add-in cards are electrically connected to the host circuit board through the electrical connectors on the host circuit board. The add-in cards have electrical components, such as processors, memories, and the like to enhance the capabilities of the system. However, the system is limited by the amount of data that can be communicated between the add-in card and the host circuit board.

Some known systems have been designed to network the add-in cards together to enhance the capabilities of the system even further. For example, secondary electrical connectors are provided on the add-in cards that are networked together through cable assemblies. Such systems are not without disadvantages. For instance, the systems provide hardware on the add-in cards for guidance and mating of plugs of the cable assemblies with the add-in cards. Such hardware occupies valuable board space on the add-in card and/or increases the envelope of the add-in card, which either increases the overall size of the system or reduces the density of the system by reducing the number of add-in cards that are able to fit within a given framework.

A need remains for a communication system that allows electrical interconnection of add-in cards in a reliable and cost effective manner.

BRIEF DESCRIPTION OF THE INVENTION

In one embodiment, a board-to-board connector assembly is provided including a first connector, a second connector and a connector interposer between the first connector and the second connector. The first connector has a first connector housing holding first contacts and having a first card slot. The first contacts are arranged at the first card slot for interfacing with a circuit card edge of a first add-in card. The first connector housing has a board guide configured to engage the first add-in card and guide mating with the first add-in card. The first connector has a first latch configured to latchably engage the first add-in card to secure the first connector to the first add-in card. The second connector has a second connector housing holding second contacts and having a second card slot. The second contacts are arranged at the second card slot for interfacing with a circuit card edge of a second add-in card. The second connector housing has a board guide configured to engage the second add-in card and guide mating with the second add-in card. The second connector has a second latch configured to latchably engage the second add-in card to secure the second connector to the second add-in card. The connector interposer electrically interconnects the first contacts and the second contacts.

In another embodiment, an add-in card assembly is provided for a communication system having a host circuit board. The add-in card assembly includes an add-in card having a primary circuit at a primary circuit card edge configured to be plugged into a primary card edge connector of the host circuit board of the communication system. The add-in card has an electronic component electrically connected to the primary circuit. The add-in card has a secondary circuit electrically connected to the electronic component and routed to a secondary circuit card edge. The add-in card assembly includes a board-to-board connector coupled to the secondary circuit at the secondary circuit card edge. The board-to-board connector has a first connector housing holding first contacts and having a first card slot receiving the secondary circuit card edge. The first contacts are arranged at the first card slot for interfacing with the secondary circuit at the secondary circuit card edge of the add-in card. The first connector housing has a board guide engaging the add-in card to guide mating of the first connector housing with the add-in card. The first connector has a first latch latchably engaging the add-in card to secure the first connector to the add-in card.

In a further embodiment, a communication system is provided including a host circuit board having a first card edge connector coupled to the host circuit board and a second card edge connector coupled to the host circuit board. The communication system includes a first add-in card coupled to the first card edge connector having a first circuit card edge and a second add-in card coupled to the second card edge connector having a second circuit card edge. The communication system includes a board-to-board connector assembly coupled to the first add-in card at the first circuit card edge and coupled to the second add-in card at the second circuit card edge to electrically connect the first and second add-in cards. The boar-to-board connector assembly includes a first connector, a second connector and a connector interposer between the first connector and the second connector. The first connector has a first connector housing holding first contacts and having a first card slot. The first contacts are arranged at the first card slot for interfacing with a circuit card edge of a first add-in card. The first connector housing has a board guide configured to engage the first add-in card and guide mating with the first add-in card. The first connector has a first latch configured to latchably engage the first add-in card to secure the first connector to the first add-in card. The second connector has a second connector housing holding second contacts and having a second card slot. The second contacts are arranged at the second card slot for interfacing with a circuit card edge of a second add-in card. The second connector housing has a board guide configured to engage the second add-in card and guide mating with the second add-in card. The second connector has a second latch configured to latchably engage the second add-in card to secure the second connector to the second add-in card. The connector interposer electrically interconnects the first contacts and the second contacts.

DETAILED DESCRIPTION OF THE INVENTION

Figure 1:
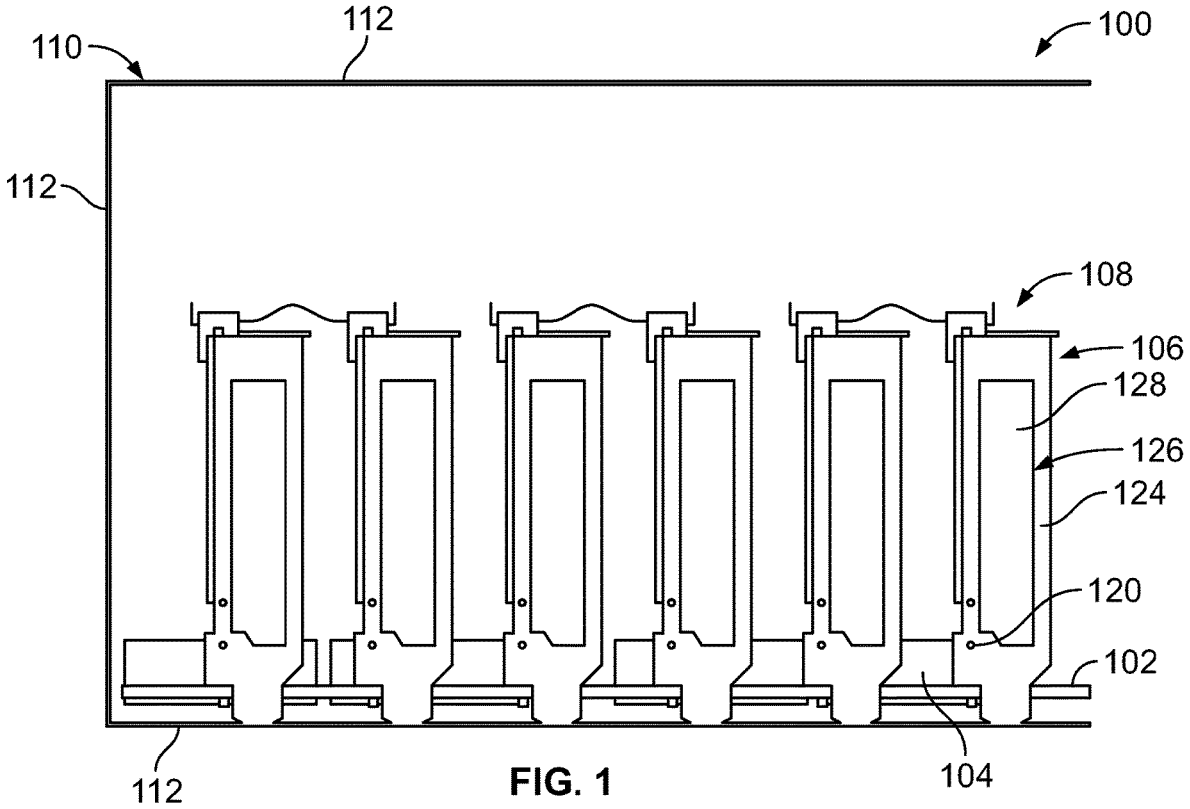
FIG. 1 is a front view of a communication system in accordance with an exemplary embodiment.
Figure 2:
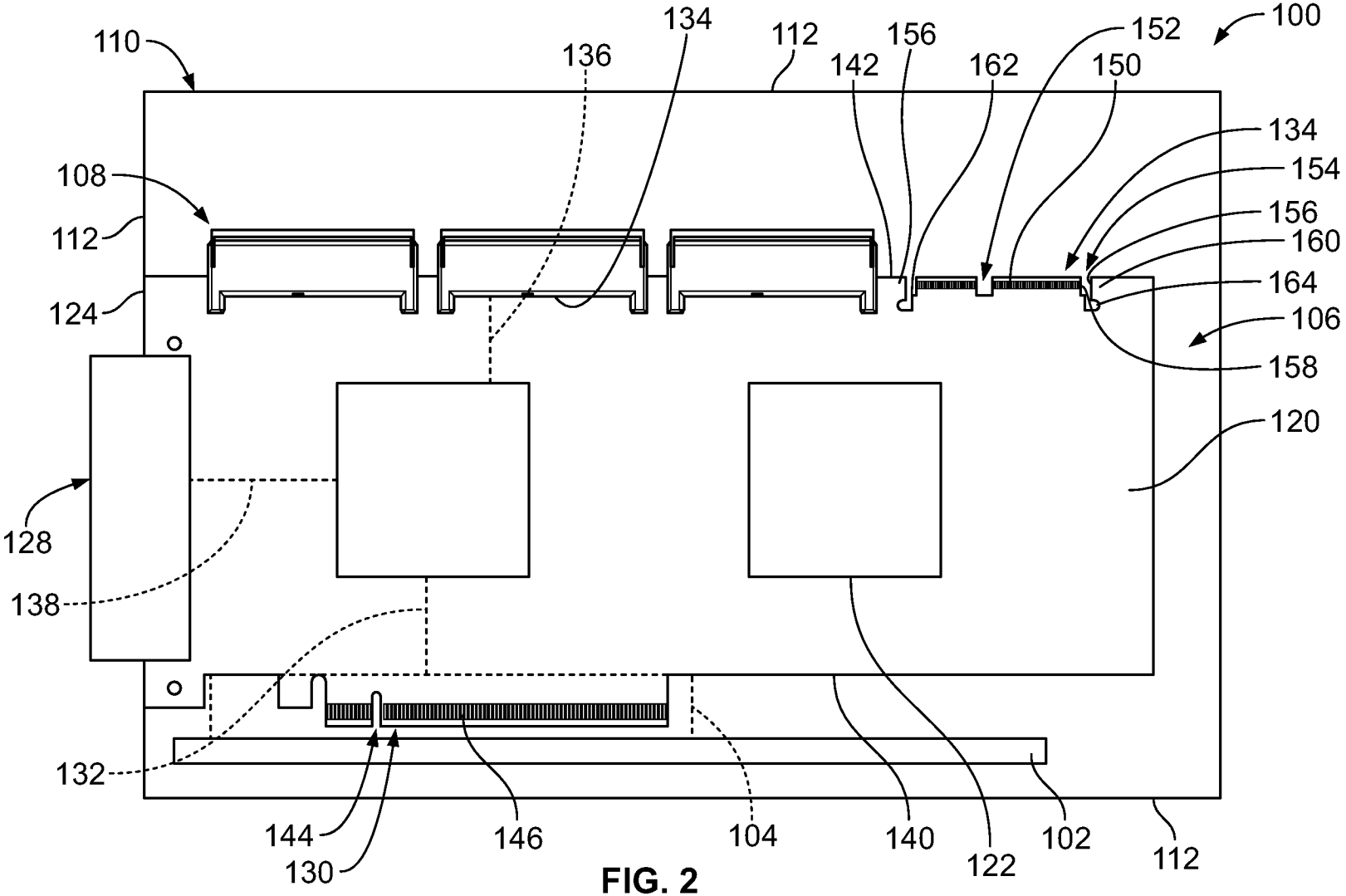
FIG. 2 is a side view of the communication system in accordance with an exemplary embodiment.

FIG. 1 is a front view of a communication system 100 in accordance with an exemplary embodiment. FIG. 2 is a side view of the communication system 100 in accordance with an exemplary embodiment. The communication system 100 may be used in an electronic device or computing device. For example, the communication system 100 may be used for high power computing, such as in a hardware accelerator, a general purpose GPU, and the like. In an exemplary embodiment, the communication system 100 includes a host circuit board 102 having electronics thereon. The host circuit board 102 includes connectors, such as card edge connectors 104 for interfacing with multiple add-in card assemblies 106.

In an exemplary embodiment, the add-in card assemblies 106 include board-to-board connector assemblies 108 to electrically connect various add-in card assemblies 106 to network the add-in card assemblies 106. The board-to-board connector assemblies 108 provide communication paths between the add-in card assemblies 106 separate from the host circuit board 102. The board-to-board connector assemblies 108 enhance processing capabilities of the communication system 100 by networking the add-in card assemblies 106. In an exemplary embodiment, the board-to-board connector assemblies 108 are low profile. Optionally, the board-to-board connector assemblies 108 allow add-in card assemblies 106 to be electrically connected to multiple other add-in card assemblies 106. In an exemplary embodiment, the board-to-board connector assemblies 108 are mounted directly to the add-in cards of the add-in card assemblies 106 to minimize components and interfaces between the components.

In an exemplary embodiment, the communication system 100 includes a chassis 110 holding the host circuit board 102 and the add-in card assemblies 106. The chassis 110 may include panels 112 forming an enclosure. The host circuit board 102 may be coupled to the chassis 110, such as coupled to a bottom panel of the chassis 110. Optionally, the host circuit board 102 may be oriented horizontally at the bottom of the chassis 110. The add-in card assemblies 106 may be located above the host circuit board 102 in various embodiments. For example, the add-in card assemblies 106 may be oriented vertically and stacked adjacent each other along the host circuit board 102.

With reference to FIG. 2, the add-in card assembly 106 includes an add-in card 120 and one or more electronic components 122 mounted to the add-in card 120. The electronic component 122 may be electrically connected to the host circuit board 102 through the card edge connector 104. For example, a primary circuit card edge 130 of the add-in card 120 may be plugged into the card edge connector 104. A primary circuit 132 may electrically connect the electronic component 122 with the primary circuit card edge 130 of the add-in card 120.

The board-to-board connector assembly 108 may be electrically connected to a secondary circuit card edge 134 of the add-in card 120. A secondary circuit 136 may electrically connect the electronic component 122 with the secondary circuit card edge 134 of the add-in card 120.

In an exemplary embodiment, the add-in card assembly 106 includes a front panel 124 mounted to a front of the add-in card 120. The front panel 124 may be coupled to the chassis 110 to present an interface for the add-in card 120 at the chassis 110. For example, the front panel 124 may include a port 126 having an interface connector 128. The interface connector 128 may be a socket connector, a header connector, a receptacle connector or another type of connector for mating with a mating connector, such as a plug connector. An interface circuit 138 may electrically connect the interface connector 128 with the electronic component 122.

In an exemplary embodiment, the primary circuit card edge 130 is provided at a bottom 140 of the add-in card 120 and the secondary circuit card edge 134 is provided at a top 142 of the add-in card 120. Optionally, the add-in card 120 may include multiple secondary circuit card edges 134 at the top 142 for interfacing with multiple board-to-board connector assemblies 108 along the top 142. In an exemplary embodiment, the primary circuit card edge 130 includes a guide slot 144 to guide mating with the card edge connector 104 (shown in phantom in FIG. 2). The add-in card 120 includes contact pads 146 arranged along the primary circuit card edge 130 for mating with the card edge connector 104. The contact pads 146 may be signal contacts, ground contacts, or power contacts. The signal contacts may be high speed signals, low speed signals and the like. The contact pads 146 may be defined by circuits of the add-in card 120, such as circuits of the primary circuit 132.

In an exemplary embodiment, the secondary circuit card edge 134 includes contact pads 150 at the circuit card edge 134. The contact pads 150 may be provided on both sides of the add-in card 120 in various embodiments. In an exemplary embodiment, the secondary circuit card edge 134 includes a guide slot 152 to guide or position the board-to-board connector assembly 108 relative to the secondary circuit card edge 134. Optionally, contact pads 150 may be provided on both sides of the guide slot 152. In an exemplary embodiment, the add-in card 120 includes channels 154 at opposite ends of the secondary circuit card edge 134. The channels 154 define the secondary circuit card edge 134 and separate the secondary circuit card edge 134 from flanking members 156 on opposite ends of the secondary circuit card edge 134. The flanking members 156 may be provided between the various circuit card edges 134. The channels 154 may be formed by removing material of the add-in card 120, such as by using a router or other device to cut or remove material to form the channel 154.

The channel 154 has an inner surface 158 extending along the circuit card edge 134 and an outer surface 160 extending along the flanking member 156. Optionally, the inner surface 158 and/or the outer surface 160 may be generally perpendicular to the top 142. In various embodiments, the inner surface 158 and/or the outer surface 160 at the top 142 may be chamfered to provide a lead-in to the channel 154 to guide the board-to-board connector assembly 108 into the channel 154. In various embodiments, the inner surface 158 and/or the outer surface 160 may be stepped having one or more shoulders 162. The inner surface 158 and/or the outer surface 160 may be used as a guide surface to guide mating of the board-to-board connector assembly 108 with the add-in card 120. In an exemplary embodiment, the channel 154 includes a notch 164 at a bottom of the channel 154. The notch 164 is formed under the flanking member 156 in the illustrated embodiment. In an exemplary embodiment, the notch 164 is used for latching the board-to-board connector assembly 108 directly to the add-in card 120.

Figure 3:
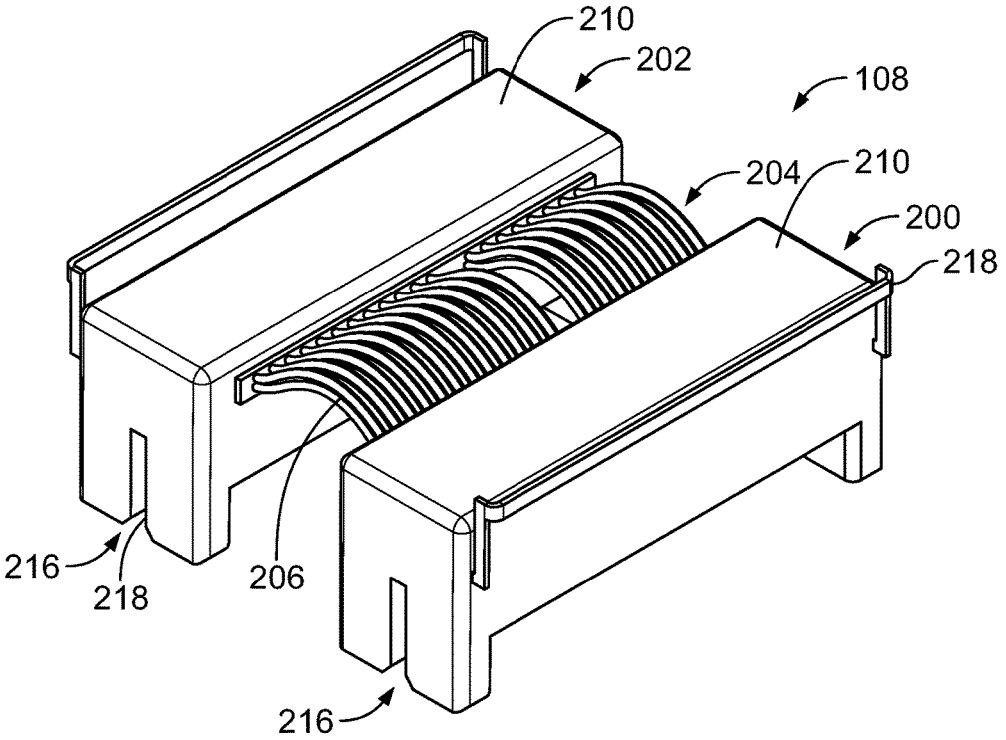
FIG. 3 is a perspective view of a board-to-board connector assembly of the communication system in accordance with an exemplary embodiment.

FIG. 3 is a perspective view of the board-to-board connector assembly 108 in accordance with an exemplary embodiment. The board-to-board connector assembly 108 includes a first connector 200, a second connector 202 and a connector interposer 204 between the first connector 200 and the second connector 202. Optionally, the second connector 202 may be similar to, or even identical to, the first connector 200, and like components may be identified with like reference numerals with or without the "first" or "second" identifiers, respectively.

In the illustrated embodiment, the connector interposer 204 includes wires 206 between the first and second connectors 200, 202. However, in alternative embodiments, the connector interposer 204 may include another type of interconnect, such as a flexible circuit, a printed circuit board, or another type of interconnect. In the illustrated embodiment, the connector interposer 204 electrically connects the first connector 200 to the second connector 202. In other various embodiments, the connector interposer 204 may electrically connect the first connector 200 to one or more additional connectors and/or may electrically connect the second connector 202 one or more additional connectors.

Figure 4:
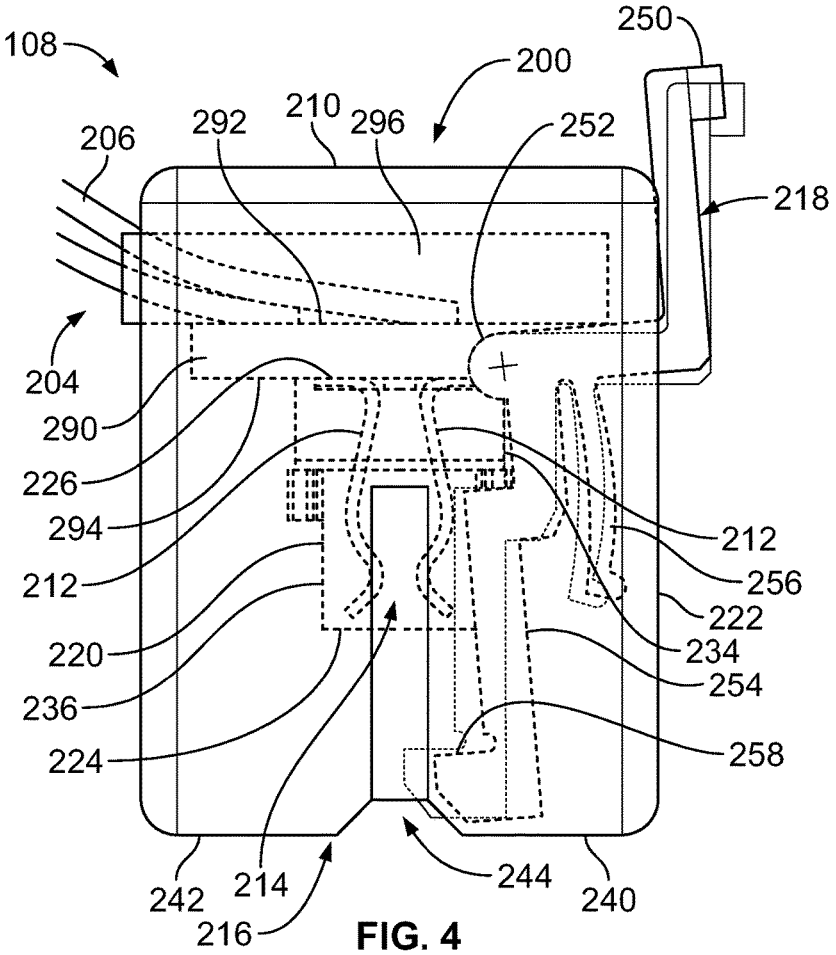
FIG. 4 is an end view of a connector of the board-to-board connector assembly in accordance with an exemplary embodiment.
Figure 5:
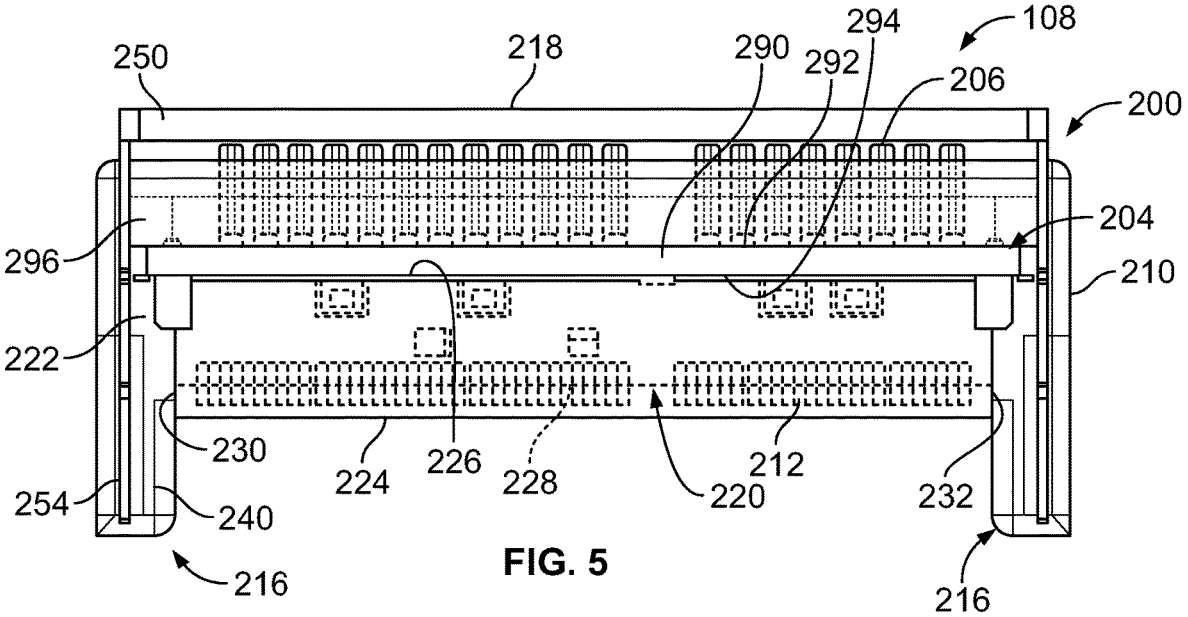
FIG. 5 is a side view of the connector of the board-to-board connector assembly in accordance with an exemplary embodiment.

The connector 200 includes a connector housing 210 holding contacts 212 (shown in FIGS. 4 and 5). The connector housing 210 has a card slot 214 (shown in FIG. 4) for interfacing with the circuit card edge 134 (shown in FIG. 2) of the add-in card 120 (shown in FIG. 2). The connector housing 210 has a board guide 216 configured to engage the add-in card 120 and guide mating with the add-in card 120. The connector 200 has a latch 218 configured to latchably engage the add-in card 120 to secure the connector 200 to the add-in card 120.

The second connector 202 similarly includes a second connector housing 210 holding second contacts 212 in a second card slot 214 and having a second board guide 216 and a second latch 218. The connector interposer 204 electrically connects the first contacts 212 of the first connector 200 with the second contacts 212 of the second connector 202. The connector interposer 204 extends between the first connector housing 210 of the first connector 200 and the second connector housing 210 of the second connector 202.

FIG. 4 is an end view of the connector 200 of the board-to-board connector assembly 108 in accordance with an exemplary embodiment. FIG. 5 is a side view of the connector 200 of the board-to-board connector assembly 108 in accordance with an exemplary embodiment.

In an exemplary embodiment, the connector housing 210 of the connector 200 is a multi-piece housing including a connector body 220 and a cover 222 holding the connector body 220. In alternative embodiments, the connector housing 210 is a single piece housing rather than a multi-piece housing. The connector body 220 holds the contacts 212 (FIG. 5) and defines the card slot 214 (FIG. 5) that receives the circuit card edge 134 (shown in FIG. 2) of the add-in card 120 (shown in FIG. 2). The connector body 220 extends between a front 224 and a rear 226. The card slot 214 is open at the front 224 to receive the circuit card edge 134. As depicted in FIG. 5, the card slot 214 extends along a longitudinal axis 228 between opposite ends 230, 232 of the connector body 220. The contacts 212 are arranged along the card slot 214, such as based apart longitudinally the length of the card slot 214. Optionally, the contacts 212 may be arranged on opposite sides 234, 236 of the connector body 220, such as on both sides of the card slot 214 to engage both sides of the circuit card edge 134.

The cover 222 holds the connector body 220, the latch 218 and defines the board guide 216. In the illustrated embodiment, the board guide 216 includes a first support arm 240 and a second support arm 242 separated from the first support arm 240 by a gap 244. The gap 244 is aligned with the card slot 214. The gap 244 is configured to receive the add-in card 120, such as the circuit card edge 134 and/or the flanking members 156 (shown in FIG. 2). The first support arm 240 is configured to engage a first side of the add-in card 120 and the second support arm 242 is configured to engage a second side of the add-in card 120. In the illustrated embodiment, the support arms 240, 242 extend forward of the front 224 of the connector body 220. The support arms 240, 242 are configured to engage the add-in card 120 prior to the connector body 220 receiving the add-in card 120. The board guide 216 is used to guide the add-in card 120 into the card slot 214 of the connector body 220. Optionally, the end of the board guide 216 may define a hard stop configured to engage the top edge of the add-in card 120 when fully loaded to position the connector body 220 relative to the add-in card 120.

In an exemplary embodiment, latch 218 extends through the board guide 216. For example, the latch 218 may be pivotably coupled to the cover 222 of the connector housing 210. In an exemplary embodiment, the latch 218 includes an actuator 250 extending from a hub 252 and a latching arm 254 extending from the hub 252. The actuator 250 extends to an exterior of the connector housing 210 to be accessed and actuated by an operator to release the latch 218 from the add-in card 120 to remove the connector 200 from the add-in card 120. For example, the latch 218 may be pivoted to an unlatched or released position. In the illustrated embodiment, the latch 218 is actuated in a direction perpendicular to the longitudinal axis 228. Optionally, the latch 218 includes a return spring 256 engaging the connector housing 210 to return the latch 218 to a latching position when the actuator 250 is released. In the illustrated embodiment, the return spring 256 extends from the actuator 250. The return spring 256 may extend from the latching arm 254 or the hub 252 in other embodiments. The latching arm 254 includes a latching surface 258 configured to engage the add-in card 120 to latchably couple the connector 200 to the add-in card 120. For example, the latching surface 258 may engage the outer surface 160 of the channel 154, such as the notch 164 of the channel 154 (shown in FIG. 2) to latchably secure the connector 200 to the add-in card 120. In an exemplary embodiment, the latching surface 258 is configured to directly engage the add-in card 120 to secure the connector 200 to the add-in card 120.

In an exemplary embodiment, the connector interposer 204 includes a circuit board 290 the circuit board 290 includes a first surface 292 and a second surface 294. In the illustrated embodiment, the wires 206 are terminated to the first surface 292. For example, the wires 206 may be soldered to contact pads on the first surface 292. The contacts 212 are terminated to the second surface 294. For example, the contacts 212 may be through-hole or press-fit mounted to via of the circuit board 290. In other various embodiments, the contacts 212 may be soldered to contact pads on the second surface 294. The circuit board 290 is held in the cover 222. Optionally, a portion of the cover 222 may be filled with material 296 to secure the wires 206 and/or the circuit board 290 in the cover 222. For example, the material 296 may provide strain relief for the wires 206. The material 296 may be a plastic material or a hot melt material. The material 296 may be injected into the cover 222. The material 296 may be formed in place, such as an overmold material.

Figure 6:
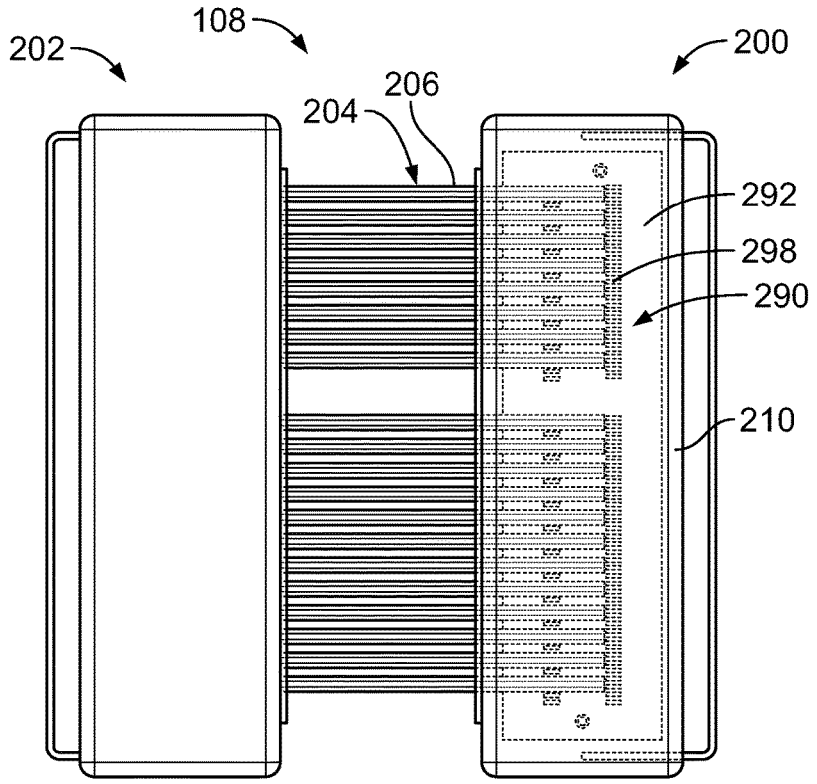
FIG. 6 is a top view of the board-to-board connector assembly in accordance with an exemplary embodiment.

FIG. 6 is a top view of the board-to-board connector assembly 108 in accordance with an exemplary embodiment showing the connector interposer 204 in the first connector 200 in phantom. The wires 206 extend into the connector housing 210 and are terminated to the circuit board 290. For example, the wires 206 may be soldered to contact pads 298 on the first surface 292 of the circuit board 290. The wires 206 are flexible to allow relative spacing between the first and second connectors 200, 202. The flexible wires 206 may allow the first connector 200 or the second connector 202 to be removed from the add-in card 120 without needing to remove the other connector 200 or 202.

Figure 7:
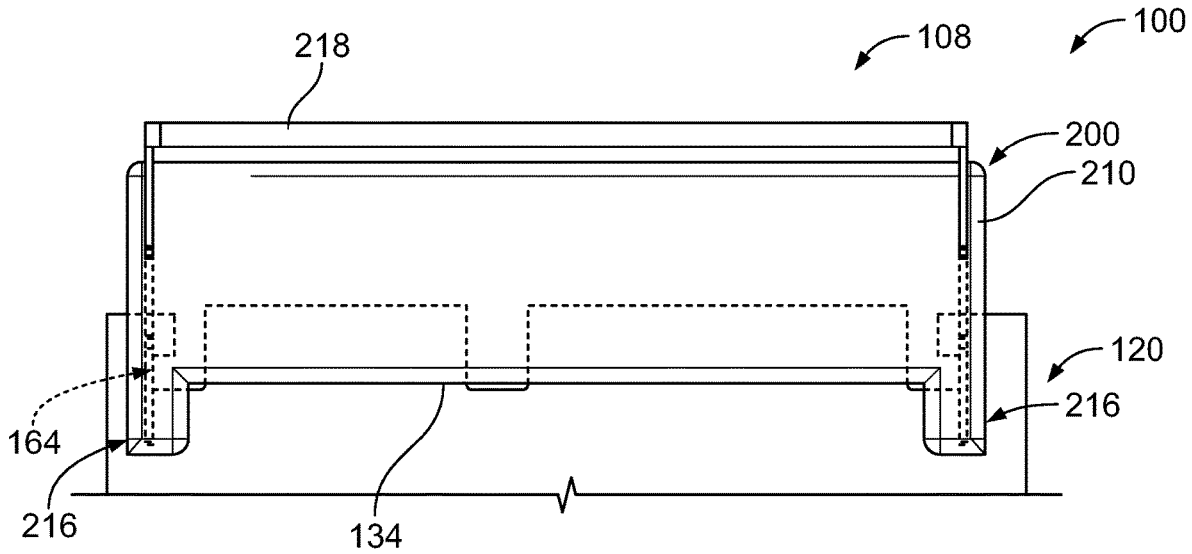
FIG. 7 is a side view of the board-to-board connector assembly mounted to an add-in card in accordance with an exemplary embodiment.
Figure 8:
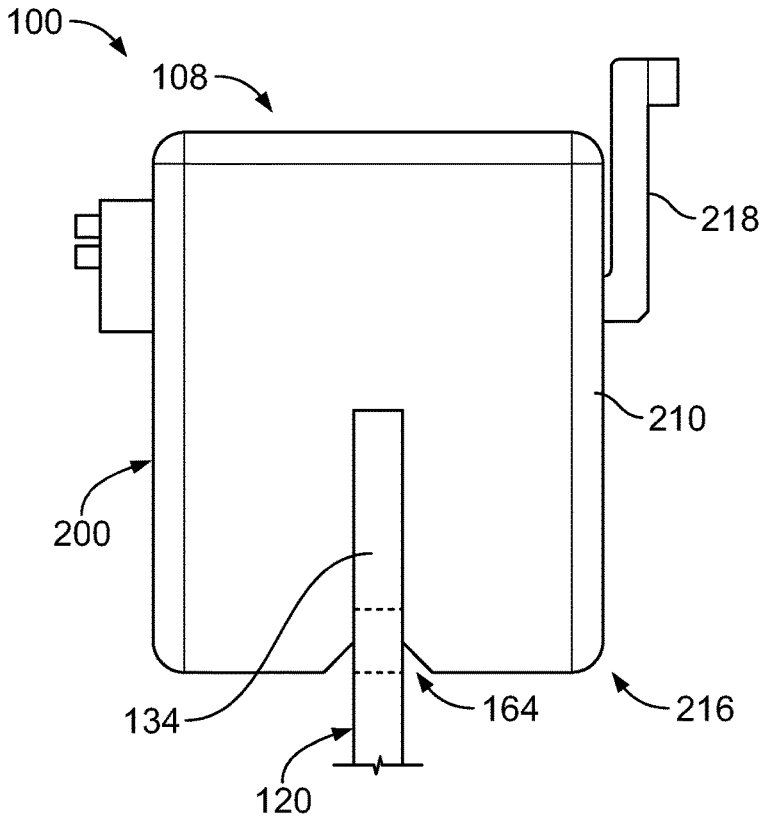
FIG. 8 is an end view of the board-to-board connector assembly mounted to the add-in card in accordance with an exemplary embodiment.

FIG. 7 is a side view of the board-to-board connector assembly 108 mounted to the add-in card 120 in accordance with an exemplary embodiment. FIG. 8 is an end view of the board-to-board connector assembly 108 mounted to the add-in card 120 in accordance with an exemplary embodiment. The connector housing 210 is mounted directly to the add-in card 120 at the circuit card edge 134. The circuit card edge 134 plugs into the connector 200. The connector 200 is supported directly on the add-in card 120. The board guide 216 guides mating with the add-in card 120 and supports the connector 200 on the add-in card 120. The latch 218 is located in the board guide 216 to directly engage the add-in card 120. In the latched position, the latch 218 is received in the notch 164 (shown in FIG. 2) to secure the connector 200 to the add-in card 120.

The board-to-board connector assembly 108 makes an electrical connection to the add-in card 120 across a single electrical interface with the circuit card edge 134 of the add-in card 120. The communication system 100 does not provide a separate connector mounted to the add-in card 120 that the board-to-board connector assembly is mated to. Rather, the board-to-board connector assembly 108 mates directly to the circuit card edge 134 of the add-in card 120. The mating guidance is provided by the interaction between the add-in card 120 and the board guide 216. The latching is provided by the latch 218 directly engaging the add-in card 120.

Figure 9:
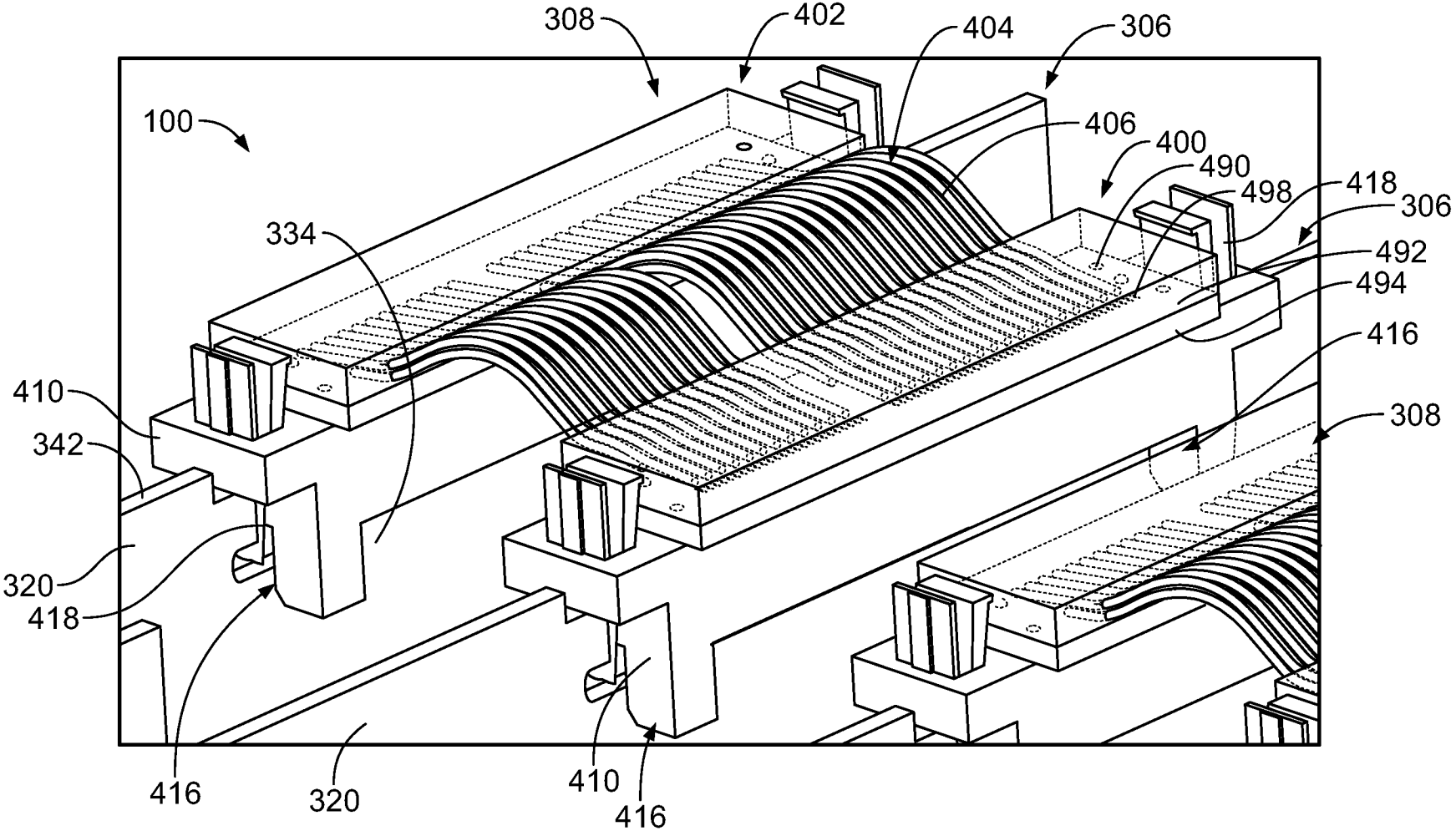
FIG. 9 is an end view of the board-to-board connector assembly mounted to the add-in card in accordance with an exemplary embodiment.

FIG. 9 is a perspective view of a portion of the communication system 100 in accordance with an exemplary embodiment showing board-to-board connector assemblies 308 coupled to corresponding add-in card assemblies 306. The add-in card assemblies 306 are similar to the add-in card assemblies 106 shown in FIGS. 1 and 2; however, the add-in card assemblies 306 are shaped differently to interface with the board the board connector assemblies 308. The board-to-board connector assemblies 308 are similar to the board-to-board connector assemblies 108 shown in FIGS. 1 and 2; however, the board-to-board connector assemblies 308 may attach to the add-in card assemblies 306 differently. In an exemplary embodiment, the board-to-board connector assemblies 308 are mounted directly to the add-in cards of the add-in card assemblies 306 to minimize components and interfaces between the components.

The add-in card assembly 306 includes an add-in card 320 configured to be electrically connected to a card edge connector of a host circuit board. The add-in card 320 includes a circuit card edge 334 at a top 342 of the add-in card 320. The board-to-board connector assembly 308 is electrically connected to the circuit card edge 334 of the add-in card 320. The board-to-board connector assembly 308 is configured to be directly attached to the add-in card 320 at the circuit card edge 334.

The board-to-board connector assembly 308 includes a first connector 400, a second connector 402 and a connector interposer 404 between the first connector 400 and the second connector 402. Optionally, the second connector 402 may be similar to, or even identical to, the first connector 400, and like components may be identified with like reference numerals with or without the "first" or "second" identifiers, respectively.

In the illustrated embodiment, the connector interposer 404 includes wires 406 between the first and second connectors 400, 402. However, in alternative embodiments, the connector interposer 404 may include another type of interconnect, such as a flexible circuit, a printed circuit board, or another type of interconnect. In the illustrated embodiment, the connector interposer 404 electrically connects the first connector 400 to the second connector 402. In other various embodiments, the connector interposer 404 may electrically connect the first connector 400 to one or more additional connectors and/or may electrically connect the second connector 402 one or more additional connectors.

Figure 11:
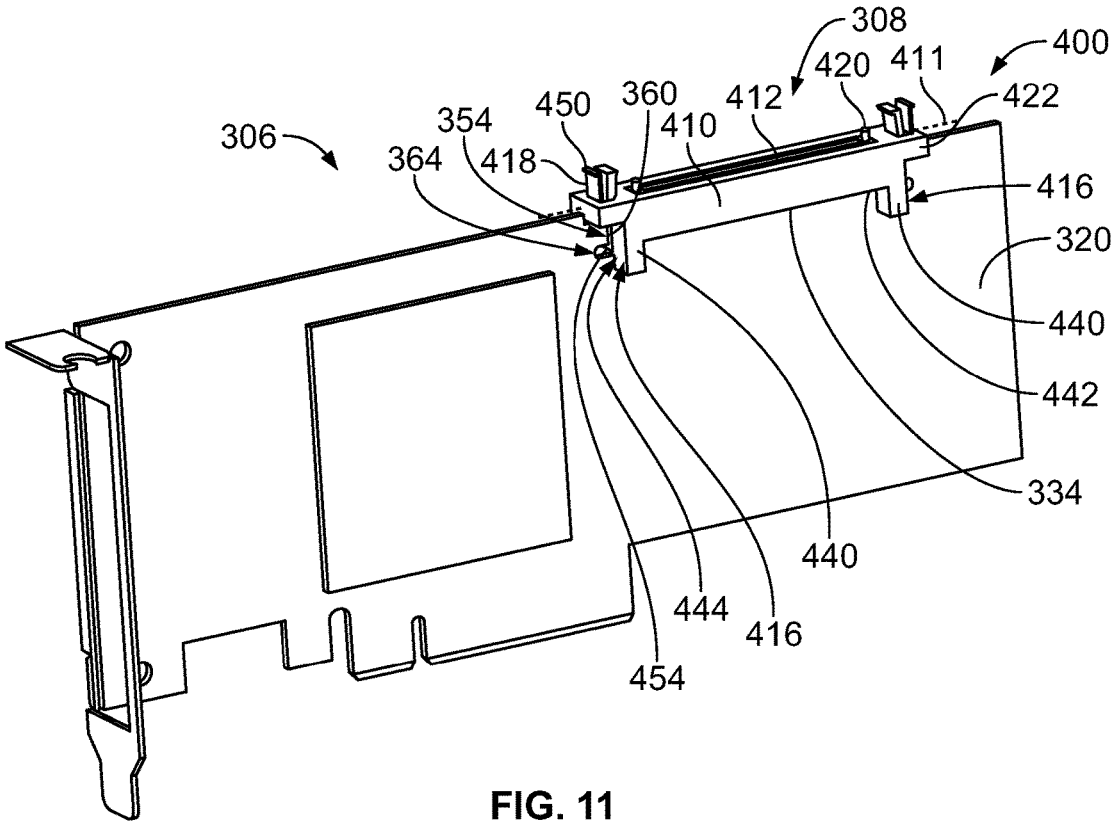
FIG. 11 is a perspective view of the add-in card assembly showing a portion of the board-to-board connector assembly mounted to the add-in card.

The connector 400 includes a connector housing 410 holding contacts 412 (shown in FIG. 11). The connector housing 410 has a card slot (not shown) for interfacing with the circuit card edge 334 of the add-in card 320. The connector housing 410 has a board guide 416 configured to engage the add-in card 320 and guide mating with the add-in card 320. The connector 400 has a latch 418 configured to latchably engage the add-in card 320 to secure the connector 400 to the add-in card 320.

In an exemplary embodiment, the connector interposer 404 includes a circuit board 490 having a first surface 492 and a second surface 494. In the illustrated embodiment, the wires 406 are terminated to the first surface 492. For example, the wires 406 may be soldered to contact pads 498 on the first surface 492. The contacts 412 are terminated to the second surface 494. For example, the contacts 412 may be through-hole or press-fit mounted to via of the circuit board 490. In other various embodiments, the contacts 412 may be soldered to contact pads on the second surface 494. The circuit board 490 is held by the connector housing 410. Optionally, material may be molded over the wires 406 and/or the circuit board 490 to provide strain relief for the wires 406.

The second connector 402 similarly includes a second connector housing 410 holding second contacts 412 in a second card slot and having a second board guide 416 and a second latch 418. The connector interposer 404 electrically connects the first contacts 412 of the first connector 400 with the second contacts 412 of the second connector 402. The connector interposer 404 extends between the first connector housing 410 of the first connector 400 and the second connector housing 410 of the second connector 402.

Figure 10:
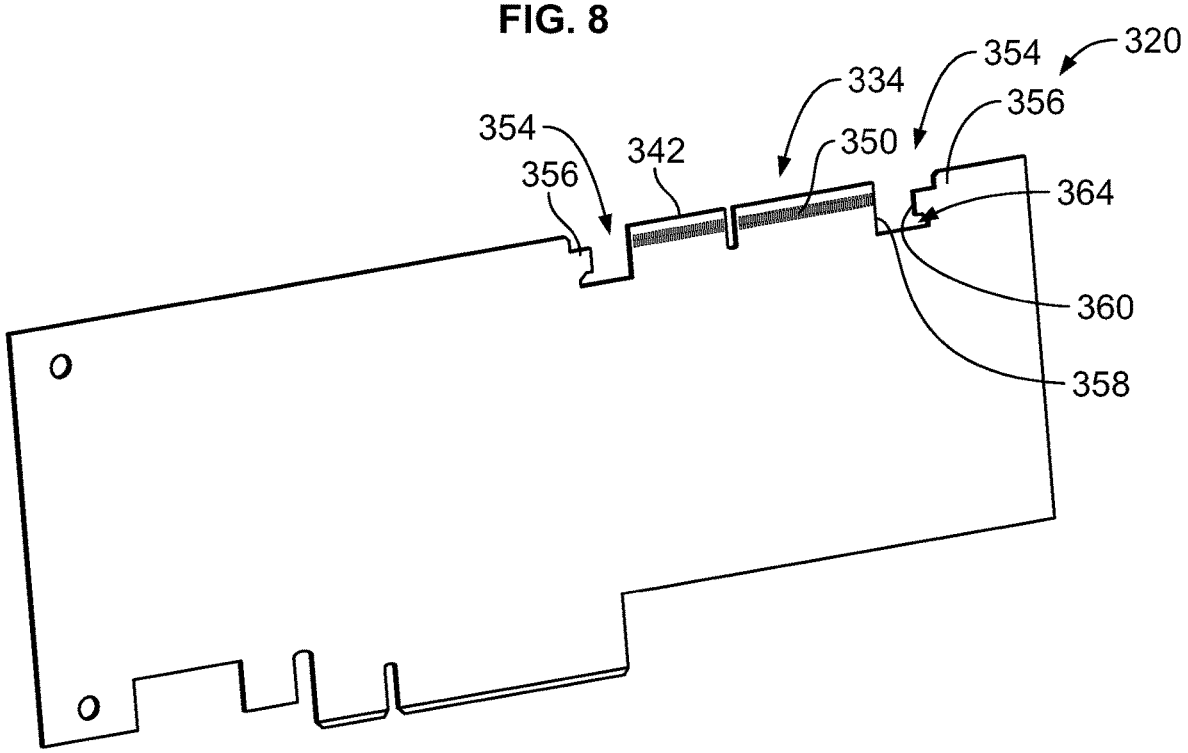
FIG. 10 is a perspective view of the add-in card in accordance with an exemplary embodiment.

FIG. 10 is a perspective view of the add-in card 320 in accordance with an exemplary embodiment. In an exemplary embodiment, the circuit card edge 334 includes contact pads 350 at the circuit card edge 334. In an exemplary embodiment, the add-in card 320 includes channels 354 at opposite ends of the circuit card edge 334. The channels 354 define the circuit card edge 334 and separate the circuit card edge 334 from flanking members 356 on opposite ends of the circuit card edge 334. The flanking members 356 may be provided between the various circuit card edges 334.

The channel 354 has an inner surface 358 extending along the circuit card edge 334 and an outer surface 360 extending along the flanking member 356. Optionally, the inner surface 358 and/or the outer surface 360 may be generally perpendicular to the top 342. In various embodiments, the inner surface 358 and/or the outer surface 360 at the top 342 may be chamfered to provide a lead-in to the channel 354 to guide the board-to-board connector assembly 308 into the channel 354. In various embodiments, the inner surface 358 and/or the outer surface 360 may be stepped having one or more shoulders. The inner surface 358 and/or the outer surface 360 may be used as a guide surface to guide mating of the board-to-board connector assembly 308 with the add-in card 320. In an exemplary embodiment, the channel 354 includes a notch 364 at a bottom of the channel 354. The notch 364 is formed under the flanking member 356 in the illustrated embodiment. In an exemplary embodiment, the notch 364 is used for latching the board-to-board connector assembly 308 directly to the add-in card 320. For example, the notch 364 is configured to receive the latch 418 of the connector 400 (shown in FIG. 9).

Figure 12:
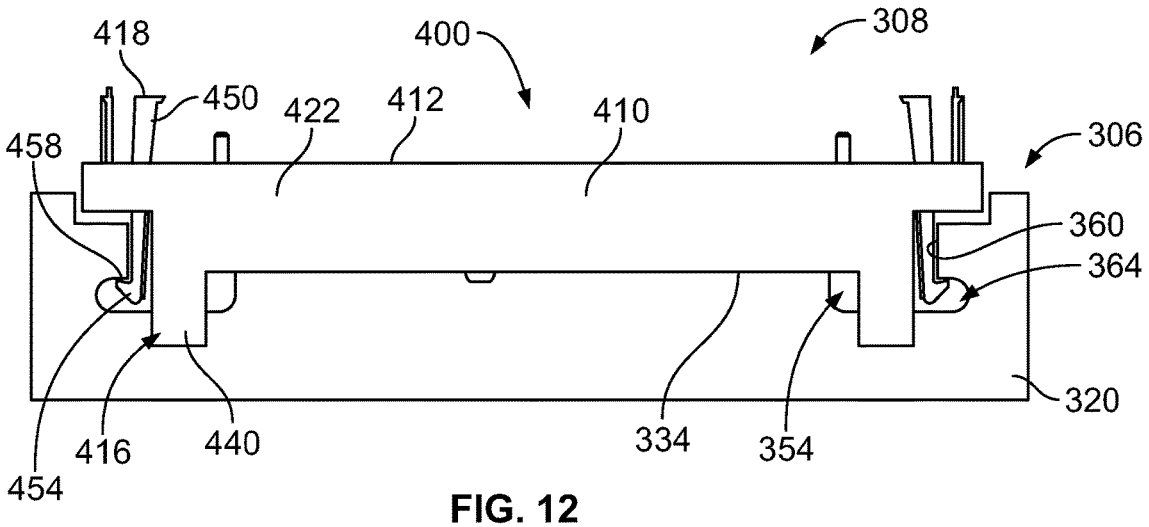
FIG. 12 is a side view of a portion of the add-in card assembly showing a portion of the board-to-board connector assembly mounted to the add-in card.

FIG. 11 is a perspective view of the add-in card assembly 306 showing a portion of the board-to-board connector assembly 308 mounted to the add-in card 320. FIG. 12 is a side view of a portion of the add-in card assembly 306 showing a portion of the board-to-board connector assembly 308 mounted to the add-in card 320.

In an exemplary embodiment, the connector housing 410 of the connector 400 is a multi-piece housing including a connector body 420 and a cover 422 holding the connector body 420. In alternative embodiments, the connector housing 410 is a single piece housing rather than a multi-piece housing. The connector body 420 holds the contacts 412 and defines the card slot (not shown) that receives the circuit card edge 334 (shown in FIG. 10) of the add-in card 320 (shown in FIG. 10). The cover 422 holds the latch 418. In an exemplary embodiment, the cover 422 defines the board guide 416. For example, in the illustrated embodiment, the board guide 416 includes a first support arm 440 and a second support arm 442 separated from the first support arm 440 by a gap 444 aligned with the card slot 414 to receive the add-in card 320. The support arms 440, 442 engage both sides of the add-in card 320 to support the connector body 420 on the add-in card 320. In an exemplary embodiment, the latch 418 is pivotably coupled to the connector housing 410. In an exemplary embodiment, the latch 418 includes an actuator 450 and a latching arm 454 having a latching surface 458 configured to engage the add-in card 320 to latchably couple the connector 400 to the add-in card 320. For example, the latching surface 458 may engage the outer surface 360 of the channel 354, such as in the notch 364 of the channel 354. In an exemplary embodiment, the latch 418 is actuated in a direction parallel to a longitudinal axis 411 of the connector housing 410. For example, the exposed end of the latch 418 at the top of the latch 418 may be pushed outward to actuate the latch 418.

Figure 13:
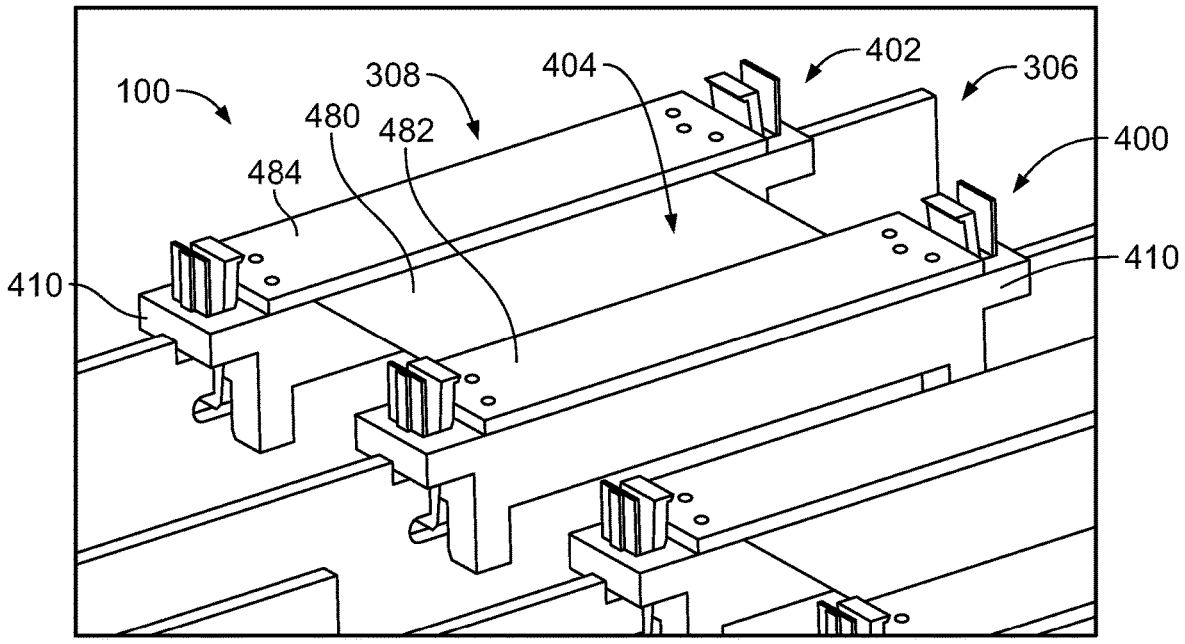
FIG. 13 is a perspective view of a portion of the communication system in accordance with an exemplary embodiment showing the board-to-board connector assemblies coupled to corresponding add-in card assemblies.

FIG. 13 is a perspective view of a portion of the communication system 100 in accordance with an exemplary embodiment showing the board-to-board connector assemblies 308 coupled to corresponding add-in card assemblies 306. In the illustrated embodiment, the connector interposer 404 is illustrated including a flexible circuit 480 rather than the individual wires 406 illustrated in FIG. 9. In the illustrated embodiment, the connector interposer 404 includes backer plates 482, 484 configured to be coupled to the connector housings 410 of the first and second connectors 400, 402. The backer plates 482, 484 provide a rigid substrate for securing the flexible circuit 480 to the contacts 412 of the first and second connectors 400, 402. For example, the contacts 412 of the first and second connectors 400, 402 may include spring beams and the backer plates 482, 484 may compress the flexible circuit 480 against the spring beams to create an electrical connection therebetween. The flexible circuit 480 may be electrically connected to the contacts 412 by other means in alternative embodiments. Rather than backer plates, the connector interposer 404 may include rigid circuit boards with the flexible circuit 480 therebetween.

Figure 14:
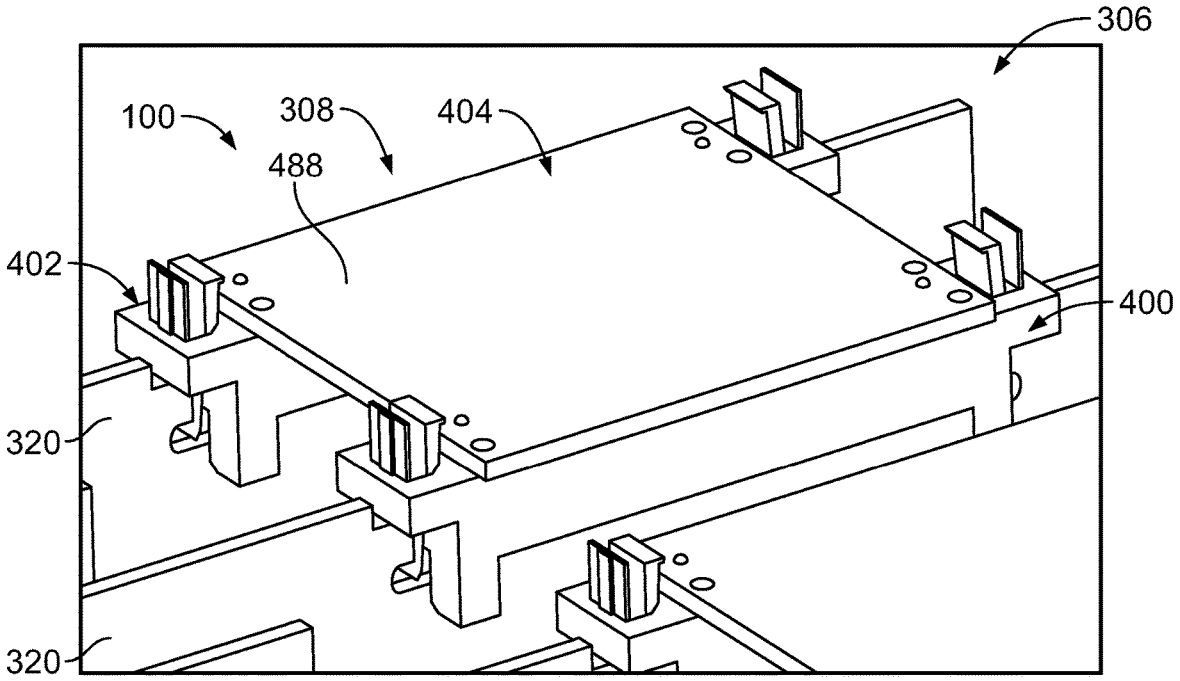
FIG. 14 is a perspective view of a portion of the communication system in accordance with an exemplary embodiment showing the board-to-board connector assemblies coupled to corresponding add-in card assemblies.

FIG. 14 is a perspective view of a portion of the communication system 100 in accordance with an exemplary embodiment showing the board-to-board connector assemblies 308 coupled to corresponding add-in card assemblies 306. In the illustrated embodiment, the connector interposer 404 is illustrated as a circuit board 488 extending between the first and second connectors 400, 402. The circuit board 488 replaces the individual circuit boards 490 of the first and second connectors 400, 402 and wires 406 illustrated in FIG. 9. The circuit board 488 eliminates interfaces between the first and second connectors 400, 402 compared to using the wires 406; however, the circuit board 488 is rigid and requires more precise positioning of the first and second connectors 400, 402 compared to the embodiment utilizing the wires 406. The circuit board 488 is terminated directly to the contacts 412 of the first connector 400 and the contacts 412 of the second connector 402 to create the electrical path between the add-in cards 320.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A board-to-board connector assembly comprising:

a first connector having a first connector housing holding first contacts, the first connector housing having a first card slot, the first contacts being arranged at the first card slot for interfacing with contact pads at first and second sides of a circuit card edge of a first add-in card, the circuit card edge of the first add-in card being plugged into the first card slot to engage the first contacts, the first connector housing having a board guide configured to engage the first add-in card and guide mating with the first add-in card, the first connector having a first latch configured to latchably engage the first add-in card to secure the first connector to the first add-in card;

a second connector having a second connector housing holding second contacts, the second connector housing having a second card slot, the second contacts being arranged at the second card slot for interfacing with contact pads at first and second sides of a circuit card edge of a second add-in card, the circuit card edge of the second add-in card being plugged into the second card slot to engage the second contacts, the second connector housing having a board guide configured to engage the second add-in card and guide mating with the second add-in card, the second connector having a second latch configured to latchably engage the second add-in card to secure the second connector to the second add-in card; and a connector interposer between the first connector and the second connector to electrically interconnect the first contacts and the second contacts.

2. The board-to-board connector assembly of claim 1, wherein the first connector is mounted directly to the first add-in card at the circuit card edge of the first add-in card for direct electrical connection with the contact pads of the first add-in card, and the second connector is mounted directly to the second add-in card at the circuit card edge of the second add-in card for direct electrical connection with the contact pads of the second add-in card.

3. The board-to-board connector assembly of claim 1, wherein the board guide of the first connector includes a guide surface configured to directly engage the first add-in card to support the first connector on the first add-in card and wherein the board guide of the second connector includes a guide surface configured to directly engage the second add-in card to support the second connector on the second add-in card.

4. The board-to-board connector assembly of claim 1, wherein the board guide of the first connector is configured to be received in a channel in the first add-in card defining the circuit card edge of the first add-in card and wherein the board guide of the second connector is configured to be received in a channel in the second add-in card defining the circuit card edge of the second add-in card.

5. The board-to-board connector assembly of claim 1, wherein the first connector housing includes a first connector body including the first card slot and holding the first contacts and the first connector housing includes a first cover holding the first connector body, the first cover including the board guide and holding the first latch, the board guide including a first support arm and a second support arm separated by a gap configured to receive the first add-in card, the first support arm engaging a first side of the first add-in card, the second support arm engaging a second side of the first add-in card.

6. The board-to-board connector assembly of claim 1, wherein the first latch is in the board guide of the first connector.

7. The board-to-board connector assembly of claim 1, wherein the connector interposer includes a plurality of wires between the first contacts and the second contacts.

8. The board-to-board connector assembly of claim 1, wherein the connector interposer includes a flexible circuit between the first contacts and the second contacts.

9. The board-to-board connector assembly of claim 1, wherein the connector interposer includes a circuit board extending between the first connector and the second connector.

10. The board-to-board connector assembly of claim 1, wherein the first connector includes a first circuit board, the first contacts being terminated to the first circuit board, the connector interposer being electrically connected to the first circuit board, the second connector including a second circuit board, the second contacts being terminated to the second circuit board, the connector interposer being electrically connected to the second circuit board.

11. The board-to-board connector assembly of claim 1, wherein the connector interposer is terminated directly to the first contacts and terminated directly to the second contacts.

12. The board-to-board connector assembly of claim 1, wherein the first connector includes a top and a bottom, the first connector being coupled to the first add-in card at the bottom, the second connector including a top and a bottom, the second connector being coupled to the second add-in card at the bottom, the top of the second connector being coplanar with the top of the first connector, the connector interposer extending between the first and second connectors proximate to the tops of the first and second connectors.

13. The board-to-board connector assembly of claim 1, wherein the first card slot extends along a longitudinal axis, the first latch being actuated in a direction parallel to the longitudinal axis.

14. The board-to-board connector assembly of claim 1, wherein the first card slot extends along a longitudinal axis, the first latch being actuated in a direction perpendicular to the longitudinal axis.

15. An add-in card assembly for a communication system having a host circuit board, the add-in card assembly comprising:

an add-in card having a primary circuit at a primary circuit card edge configured to be plugged into a primary card edge connector of the host circuit board of the communication system, the add-in card having an electronic component electrically connected to the primary circuit, the add-in card having a secondary circuit electrically connected to the electronic component and routed to a secondary circuit card edge; and a board-to-board connector coupled to the secondary circuit at the secondary circuit card edge, the board-to-board connector having a first connector housing having walls forming an internal cavity, the first connector housing holding first contacts in the internal cavity such that the walls of the first connector housing are exterior of the first contacts and surround the first contacts, the first connector housing having a first card slot receiving the secondary circuit card edge, the first contacts being arranged inside the first connector housing and located at the first card slot for interfacing with the secondary circuit at the secondary circuit card edge of the add-in card when the secondary circuit card edge is plugged into the first card slot, the first connector housing having a board guide directly engaging the secondary circuit card edge of the add-in card to guide mating of the first connector housing with the add-in card prior to the first contacts interfacing with the secondary circuit, the first connector having a first latch latchably engaging the add-in card to secure the first connector to the add-in card.

16. The add-in card assembly of claim 15, wherein the board-to-board connector includes a connector interposer electrically connected to the first contacts, the connector interposer being electrically connected to second contacts of a second board-to-board connector configured to be mated to a second add-in card.

17. The add-in card assembly of claim 15, wherein the first connector housing is mounted directly to the add-in card at the secondary circuit card edge of the add-in card.

18. The add-in card assembly of claim 15, wherein the add-in card includes a channel defining the secondary circuit card edge, the channel having a notch at a bottom of the channel, the latch being received in the notch.

19. The add-in card assembly of claim 15, wherein the add-in card includes a flanking member separated from the secondary circuit card edge by a channel, the board guide engaging the flanking member to support the first connector housing on the add-in card.

20. A communication system comprising:

a host circuit board having a first card edge connector coupled to the host circuit board and a second card edge connector coupled to the host circuit board;

a first add-in card including a circuit card substrate having first and second sides, the first add-in card having a first primary circuit card edge with first primary contact pads at the first and second sides of the first add-in card, the first primary circuit card edge being plugged into the first card edge connector such that the first primary contact pads are coupled to the first card edge connector, the first add-in card having a first secondary circuit card edge with first secondary contact pads at the first and second sides of the first add-in card, a second add-in card including a circuit card substrate having first and second sides, the second add-in card having a second primary circuit card edge with second primary contact pads at the first and second sides of the second add-in card, the second primary circuit card edge being plugged into the second card edge connector such that the second primary contact pads are coupled to the second card edge connector, the second add-in card having a second secondary circuit card edge with second secondary contact pads at the first and second sides of the second add-in card; and a board-to-board connector assembly coupled to the first add-in card at the first secondary circuit card edge and coupled to the second add-in card at the second secondary circuit card edge to electrically connect the first and second add-in cards, the board-to-board connector assembly comprising:

a first connector having a first connector housing holding first contacts, the first connector housing having a first card slot, the first contacts being arranged at the first card slot for interfacing with the first secondary circuit card edge of the first add-in card, the first connector housing having a board guide engaging the first add-in card and guiding mating with the first add-in card, the first connector having a first latch latchably engaging the first add-in card to secure the first connector to the first add-in card;

a second connector having a second connector housing holding second contacts, the second connector housing having a second card slot, the second contacts being arranged at the second card slot for interfacing with the second secondary circuit card edge of the second add-in card, the second connector housing having a board guide engaging the second add-in card and guiding mating with the second add-in card, the second connector having a second latch configured to latchably engage the second add-in card to secure the second connector to the second add-in card; and a connector interposer between the first connector and the second connector to electrically interconnect the first contacts and the second contacts.

* * * * *